United States Patent [19]

Thielmann et al.

[11] Patent Number: 4,916,952

[45] Date of Patent: Apr. 17, 1990

[54] MANDREL FOR BENDING PIPES

[75] Inventors: Dieter Thielmann, Willebadessen; Egon Olszewski, Paderborn-Elsen, both of Fed. Rep. of Germany

[73] Assignee: Benteler Aktiengesellschaft, Fed. Rep. of Germany

[21] Appl. No.: 135,039

[22] Filed: Dec. 18, 1987

[30] Foreign Application Priority Data

Jan. 21, 1987 [DE] Fed. Rep. of Germany ..... 3701612

[51] Int. Cl.[4] ..... B21D 9/00

[52] U.S. Cl. ..... 72/466; 72/150

[58] Field of Search ..... 72/63, 369, 465, 466, 72/150, 370; 249/65

[56] References Cited

U.S. PATENT DOCUMENTS 3,279,237 10/1966 Rader ..... 72/466

FOREIGN PATENT DOCUMENTS 1050261 2/1959 Fed. Rep. of Germany ..... 249/65

1552862 9/1969 Fed. Rep. of Germany ..... 72/150

105825 8/1981 Japan ..... 72/369

148627 8/1985 Japan ..... 72/466

7796 of 1893 United Kingdom ..... 72/466

1198220 7/1970 United Kingdom ..... 72/369

*Primary Examiner*—Robert L. Spruill

[57] ABSTRACT

A pipe supporting mandrel for use in connection with a mandrel rod of a pipe bending machine includes a hose-like part of flexible material hermetically sealed at both ends thereof and being provided at one end with a connecting piece attachable to the mandrel rod. The mandrel rod and connecting piece having a throughgoing passage for admitting a pressure medium into the flexible hose-like part. Before the start of the bending process, the flexible hose-like part is inserted into the region of the pipe to be bent and after inflation by the pressure medium it firmly engages against the inner wall of the pipe. After completion of the bending the hose-like part is deflated and the entire mandrel is withdrawn from the pipe.

2 Claims, 1 Drawing Sheet

MANDREL FOR BENDING PIPES

BACKGROUND OF THE INVENTION

The present invention relates to a method of bending pipes by means of a bending machine having a supporting mandrel attached to a connecting rod. The invention relates also to a mandrel for such a bending machine for carrying out the bending method.

In bending pipes on a bending machine it has been known to use a supporting mandrel attached to a mandrel rod. In general, the conventional supporting mandrels are either rigid mandrels in the form of a spoon-shaped mandrel or a spherical mandrel, or particularly in bending thin walled pipes also the so-called links or articulated mandrels.

In all prior art mandrels of this kind, the interior support of the pipe to be bent takes place only over a relatively minute length section as compared to the overall length of the bend. Moreover, during the bending process there occurs a relative movement between the pipe being bent and the supporting mandrel so that apart from bending forces also frictional forces resulting from the relative movement must be overcome by the bending machine. Another disadvantage is the risk that due to the relative movement the mandrel creates grooves or scorings in the inner wall of the pipe.

In another prior art bending method the pipe is filled up with a loose material such as, for example, sand or with a meltable filling substance such as, for example, synthetic resin or paraffin. The filling material or substance, however, after completion of the bending process has to be withdrawn which processing step is time consuming and expensive. Consequently, the latter method is employed only in the single part production. In the production using a bending machine, the method based on the filling material is impractical.

SUMMARY OF THE INVENTION

It is, therefore, a general object of the present invention to overcome the aforementioned the disadvantages.

More particularly, it is an object of the invention to provide an improved method of bending of pipes on a bending machine, provided with a supporting mandrel mounted on a mandrel rod which guarantees a substantially complete support of the pipe being bent over the entire bending range without reducing the output.

Another object of this invention is to provide an improved mandrel for use with a bending machine to carry out the novel bending method.

In keeping with these objects and others which will become apparent hereafter, one feature of the method of this invention resides, in the steps of inserting prior to the bending process a hose shaped mandrel having a flexible jacket into the region of the pipe to be bent, filling the flexible mandrel with a pressure medium until the jacket is expanded and firmly pressed against the inner wall of the pipe, then bending the pipe and after the completion of the bending the pressure in the medium is relieved and the mandrel is withdrawn from the pipe.

The use of such an elastically inflatable mandrel offers substantial advantages in practice. Firstly, it enables a problem-free support of the pipe to be bent over the entire bending range. Secondly, due to the inflation of the flexible mandrel, the relative movement between the pipe and mandrel in the region of bending is eliminated, whereby substantially lower bending forces are required. Thirdly, after the bending process the deflated flexible mandrel can be promptly and without problems removed from the bent pipe.

Supporting mandrel for carrying out the bending method of this invention is characterized by a connection piece projecting into an end portion of the flexible hose-like jacket and being attached at its free ends to a mandrel rod whereby the rod and the connection piece being provided with a passage for filling or discharging a pressure medium. The opposite end of the flexible hose-like jacket is hermetically closed.

The mandrel of this invention is structurally extremely simple and therefore inexpensive to manufacture. Depending on the degree of flexibility of the used material of the jacket, it can be employed for bending pipes of different diameters.

In a preferred embodiment of this invention the connecting piece is firmly connected to an end of a wire rope which extends through the hose-like jacket and at the opposite end of the jacket is connected to closing sphere against which the jacket is clamped by means of a clamping disk. With advantage, the wire rope or cord supports a plurality of spacer disks provided with axially directed throughbores for the pressure medium.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
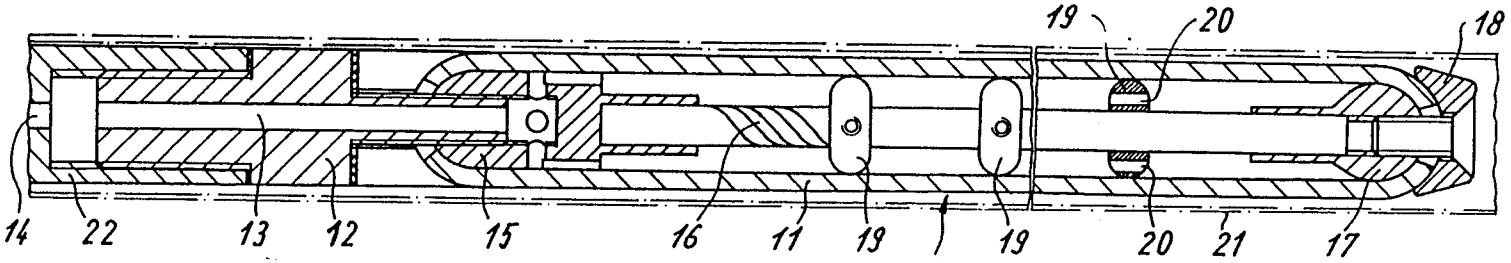
FIG. 1 is a axial section of a supporting mandrel of this invention shown in deflated condition within a pipe to be bent and in connection with a mandrel rod.
Figure 2:
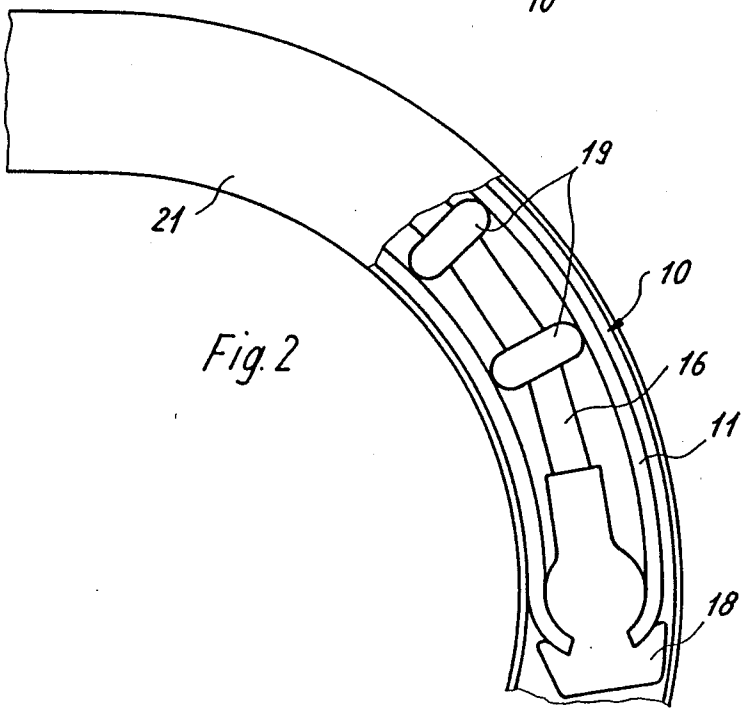
FIG. 2 shows a cut-away part of a bent pipe including the flexible mandrel of this invention.

In FIGS. 1 and 2, reference numeral 10 indicates a supporting mandrel for a pipe 21 to be bent in a bending machine. The bending machine itself is of a conventional design well-known in the art and therefore has not been illustrated.

The supporting mandrel 10 is attached, for example, by screwing, to a mandrel rod 22 of the machine.

The mandrel 10 consists of a flexible hose-like piece 11 which at one end thereof is firmly connected to a connection piece 12 whose free end is screwed into the connecting mandrel rod 22. The connection piece 12 is provided with a central pressure medium filling bore 13 communicating with the interior of the hose-like flexible piece 11. The mandrel rod 22 is also provided with a center bore 14 through which a pressure medium for example pressure oil is supplied into the interior of the hose-like flexible mandrel 11 whose free end is hermetically sealed. The pressure medium is then discharged through the same filling passages 13 and 14.

The part of the connection piece 12 which projects into the interior of the hose-like mandrel 11 is connected with a supporting piece 15 engaging the end portion of the inner wall of the hose 11 and being firmly connected to an end of a wire rope 16. The wire rope 16 extends in axial direction of the hose-like piece 11 and is secured at the opposite end thereof to a spherical support 17 which sealingly engages the inner wall wall of the free end portion of the hose-like piece 11 and is connected by a screw to a concave clamping disk 18 engaging the outer surface of the end portion and pressing the same against the sperhical support 17.

The wire rope 16 carries a plurality of spacer disks 19 spaced apart one from the other in axial direction and each being provided with axially directed throughbores 20 for passing through the pressure medium.

The outer diameter of the hose-like piece 11 which is made of flexible material, such as rubber, for example, in deflated condition is slightly smaller than the inner diameter of a pipe 21 to be bent, as indicated in FIG. 1.

Before the start of the bending process, the entire mandrel 10 in deflated condition is inserted into the pipe 21 so as to extend along the entire bending region. Then a pressure medium is introduced through the channels 14 and 13 into the interior of the flexible hose-like piece 11 and inflates the same until the flexible piece 11 firmly engages the inner wall of the pipe 21. In the inflated condition the bending machine completes the bending of the pipe 21 as shown by way of an example in FIG. 2. As soon as the bending action is finished, pressure medium is discharged through the passages 13 and 14 and the flexible hose-like piece 11 is deflated. In the deflated condition it can be easily removed from the curved pipe.

It will be seen that by virtue of the flexible supporting mandrel 10, the inner wall surface of the bending region of the pipe 21 is completely and firmly supported during the bending action so that no relative movement between the pipe and the mandrel 10 can occur. Consequently, no frictional forces are to be overcome and the risk of score formations in the inner wall of the pipe is safely eliminated.

While the invention has been illustrated and described as embodied in a specific example of a bending mandrel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pipe supporting mandrel for use in a pipe bending machine having a mandrel rod, comprising a hose-like piece of a flexible material, defining an inner wall and an outer wall; a first supporting member sealingly engaging the inner wall of an end portion of said hose-like piece; a second supporting member having a spherical surface sealingly engaging the inner wall of the opposite end portion of said hose-like piece; a connection piece for attaching said first supporting member to a mandrel rod; a flexible wire rope coaxially extending in said hose-like piece and being secured at the ends thereof to said first- and second supporting members; a concave clamping disk engaging the outer wall of said opposite end portion of the hose-like piece and being clamped against the spherical surface of said second supporting member; said connection piece being provided with an axial passage communicating with a filling opening provided in said first supporting member; and said filling opening communicating with the interior of said hose-like piece to inflate or deflate said hose-like piece by a pressure medium introduced or discharged via said axial passage.

2. A pipe supporting mandrel for use in a pipe bending machine having a mandrel rod, comprising a hose-like piece of a flexible material, defining an inner wall and an outer wall; a first supporting member sealingly engaging the inner wall of an end portion of said hose-like piece; a second supporting member having a spherical surface sealingly engaging the inner wall of the opposite end portion of said hose-like piece; a connection piece for attaching said first supporting member to a mandrel rod; a flexible wire rope coaxially extending in said hose-like piece and being secured at the ends thereof to said first- and second supporting members; a clamping disk engaging the outer wall of said opposite end portion of the hose-like piece and being clamped against the spherical surface of said second supporting member; said connection piece being provided with an axial passage communicating with a filling opening provided in said first supporting member; and said filling opening communicating with the interior of said hose-like piece to inflate or deflate said hose-like piece by a pressure medium introduced or discharged via said axial passage, and further comprising a series of spacer disks concentrically arranged on said wire rope, each spacer disk being at least externally equal to the internal diameter of the deflated hose-like piece, and each spacer disk having axially directed through bores for passing said pressure medium.

* * * * *